United States Patent [19]

Glassman

[11] Patent Number: 4,464,797

[45] Date of Patent: Aug. 14, 1984

[54] SURGICAL HEADGEAR

[76] Inventor: Jacob A. Glassman, 1680 Michigan Ave., Miami Beach, Fla. 33139

[21] Appl. No.: 226,248

[22] Filed: Jan. 19, 1981

[51] Int. Cl.[3] ..... A42B 1/24

[52] U.S. Cl. ..... 2/199; 2/181; 351/155; 128/206.19; 128/201.12

[58] Field of Search ..... 2/199, 181, 185 R, 195, 2/200, 181.4, DIG. 6, 422, 10; 351/155; 128/201.12, 206.19, DIG. 15

[56] References Cited

U.S. PATENT DOCUMENTS

| | | | |
|---|---|---|---|
| 2,345,051 | 3/1944 | Jensen | 2/185 R |
| 3,321,774 | 5/1967 | Tames | 2/181 |
| 3,512,181 | 5/1970 | Osborne | 2/195 |
| 3,531,187 | 9/1970 | Brown | 351/155 X |
| 4,274,157 | 6/1981 | Boden | 2/181.4 |
| 4,312,338 | 1/1982 | Glassman | 128/206.19 X |
| 4,387,471 | 6/1983 | Hsu et al. | 2/10 |

FOREIGN PATENT DOCUMENTS

| | | | |
|---|---|---|---|
| 1319413 | 1/1963 | France | 351/155 |

*Primary Examiner*—Peter P. Nerbun

*Attorney, Agent, or Firm*—Elmer L. Zwickel

[57] ABSTRACT

Surgical headgear, cap or other head covering having a strip of shape-retaining pliable material attached thereto and re-positionable for use to retain a pair of eyeglasses in position on the face of a wearer; and a perspiration absorptive element carried initially on the outside of the headgear and re-positionable on the interior of the headgear.

8 Claims, 9 Drawing Figures

SURGICAL HEADGEAR

The invention relates to improvements in surgical headgear and is particularly concerned with a surgical cap having affixed thereto one or more readily removable elements, one intended for use to retain a pair of eyeglasses in position on the face of a wearer and the other a perspiration absorbing element. It has been the experience of surgeons, in particular, to have their eyeglasses slide down upon the nose during operative procedures. Such sliding frequently occurs while the wearer is occupied with a task and frequently terminates in the eyeglasses falling off the wearer's face and dropping into the surgical field. To lesser degree, such sliding may carry the eyeglasses out of focus to the detriment of the patient and the chagrin of the surgeon.

The within disclosure of a surgical cap equipped with an eyeglass support involves the provision, preferably on the outside of the lower margin of the rim of the cap, of a strip of adhesively coated tape or the like which is removably attached to the cap. Also, removably secured to the exterior surface of the cap is a strip of moisture absorptive material, such as a songe, foam rubber or similar absorptive substance. Both the strip of tape and the moisture absorptive strip can be peeled off of the cap and each relocated in a position of use to be described in detail hereinafter.

This disclosure constitutes an improvement of the basic teaching of a surgical mask equipped with similar eyeglass retaining means shown and claimed in my U.S. Ser. No. 113,578, filed Jan. 31, 1980 now U.S. Pat. No. 4,312,338.

The surgical cap disclosed herein constitutes an improvement over present practice wherein a surgeon preparing for surgery will search for and often fail to find a piece of adhesive material which he intends to use to retain his eyeglasses in place. The usual practice is to select a properly shaped piece of adhesive tape and lay it over the nose bridge of the eyeglasses and adhesively secure it to the nose on one or both sides of the nosebridge. This practice is very annoying, time consuming, and very often irritates the surgeon to a degree of requiring a delay to find a proper piece of adhesive tape before starting surgery. The same situation arises when there is a need for a perspiration absorptive element and means to secure it inside the cap.

More specifically, the invention is concerned with the provision of a surgical cap provided with means adhesively or otherwise removably secured thereto that may be readily relocated thereon so as to retain eyeglasses in place on the face of the wearer; to provide individually locatable means on surgery caps for absorbing perspiration, all to reduce the time, inconveinience and annoyance of searching for separate retaining means and an absorption element.

The foregoing and other advantages of the invention will become apparent with reference to the following description and accompanying drawings, in which.

DESCRIPTION OF STRUCTURE

Figure 1:
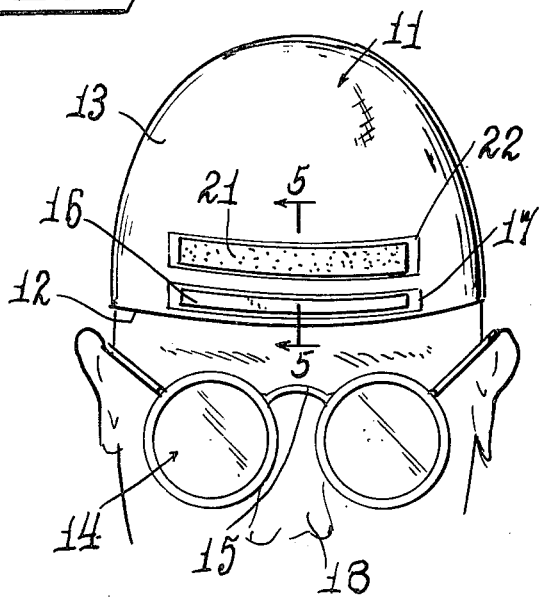
FIG. 1 is a front elevational view of the surgical cap showing the eyeglass retaining strip and perspiration member affixed to the cap prior to use.

Referring to the representative disclosure of the invention in the accompanying drawings, wherein like numbers identify like parts, and particularly to FIG. 1, the surgical headgear, or cap, 11 may be of any conventional or special construction or design, having a rim 12 and a crown 13. When the cap is being worn, the bottom edge of the rim is located on the forehead above the wearer's eyes, the space between depending upon the desire or convenience of the wearer.

Should the wearer of the cap be a surgeon or a surgical assistant or other surgical aid, wearing eyeglasses 14, which include a nose bridge 15, it is imperative that the eyeglasses be held firmly in position during surgery or other critical duties.

Some wearers push eyeglasses up on the nose as far as possible, whereas other wearers locate the nose bridge near the tip of the nose. Regardless of the wearer's preference, means is provided in the form of a narrow strip 16 of pliable shape-retaining material, such as paperboard, woven or nonwoven material, aluminum or related adhesive bearing material, which is applicable to retain the spectacles in their intended position. Referring again to FIG. 1, the strip 16 has its back surface coated with a pressure sensitive non-allergic adhesive and is initially adhesively, but removably, secured to a mounting strip 17 on cap 11. It may be positioned, as shown, adjacent to rim 12 or it may be located at any convenient position on the crown 13 of the cap. The important thing is that the strip is initially a part of the cap so that the wearer need not search for, nor improvise with some adhesive tape or other material in order to secure his eyeglasses in place.

Figure 2:
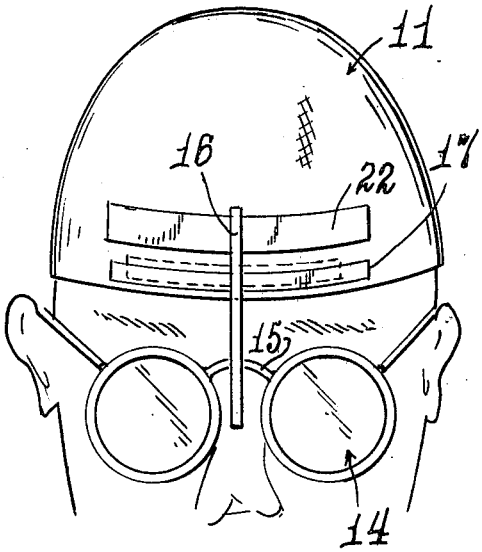
FIG. 2 is a similar view showing the eyeglass retaining means in position of use.
Figure 3:
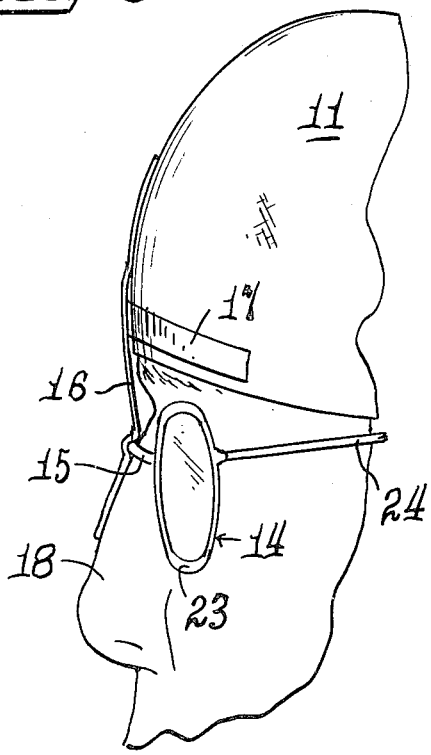
FIG. 3 is a side view of the FIG. 2 illustration detailing the securement of the eyeglasses to the nose and cap.
Figure 4:
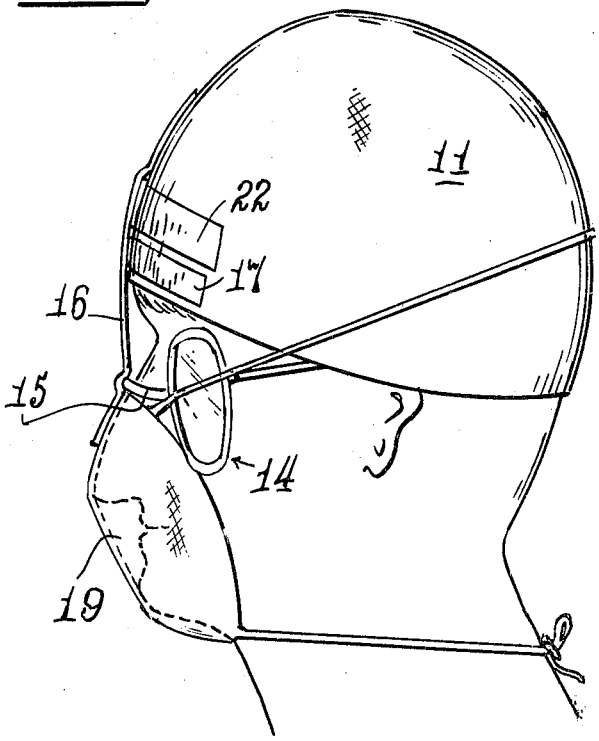
FIG. 4 is a view similar to FIG. 3 illustrating another manner of eyeglass securement by the restraining tape in combination with a surgical mask.
Figure 5:
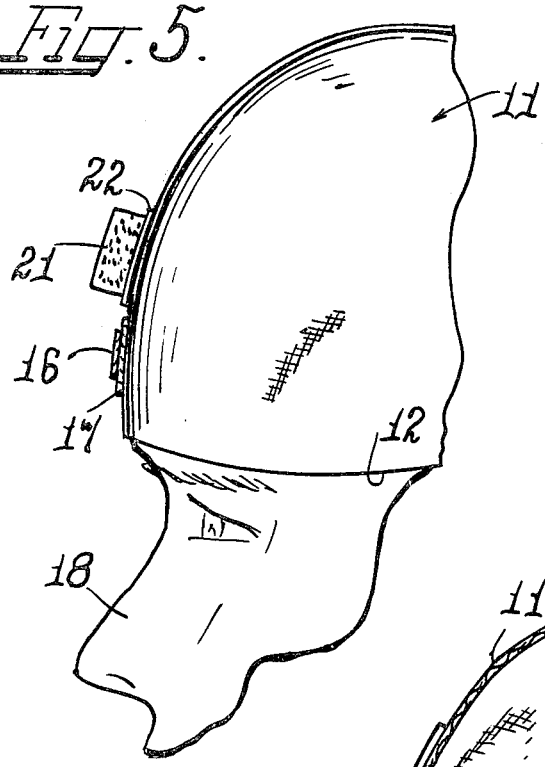
FIG. 5 is a vertical sectional view of the front wall of the surgical cap, taken substantially on line 5—5 of FIG. 3, showing the appropriate outside location of the strip and the absorption element prior to use.
Figure 6:
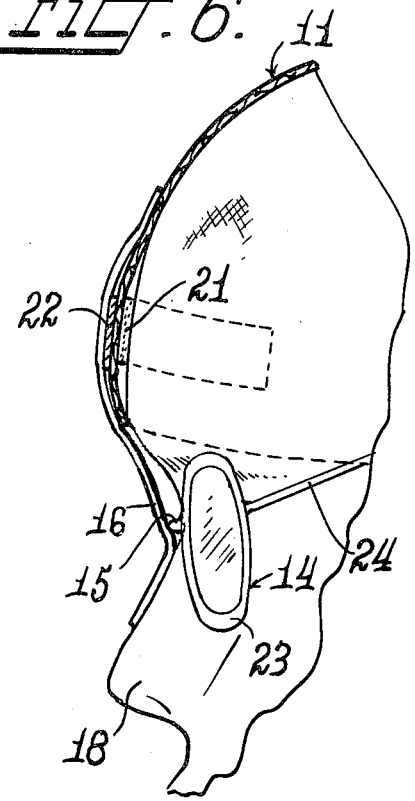
FIG. 6 is a similar sectional view illustrating the repositioned location of the strip and the absorptive element.

In any event, when the cap is worn, the adhesive tape or strip is peeled off mounting strip 17 and, as shown in FIGS. 2 and 6, is attached to the nose bridge 15 and also to the nose 18 and/or if of sufficient length, to the cap 11 and perhaps to the mask 19. In lieu of adhesively securing the strip 16 to the nose bridge, the strip 16, if made of soft shape-retaining material such as aluminum, may be bent to cause its eyeglass contacting end to be partially wrapped or crimped around nose bridge 15.

Figure 8:
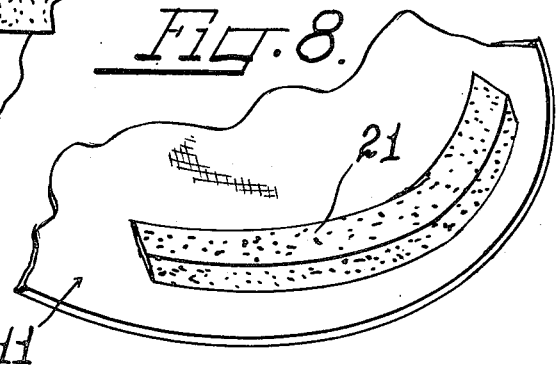
FIG. 8 is a detail perspective view of the inside of the crown of the cap, showing a specific location of the absorptive element during use.

The invention also includes the provision of a pad of perspiration absorbing material 21 which, while normally adhesively or otherwise attached, detachably, to a mounting strip 22 on the outside surface of crown area 13, may be readily peeled off and selectively attached inside the rim 12, as best illustrated in FIGS. 6 and 8.

Figure 9:
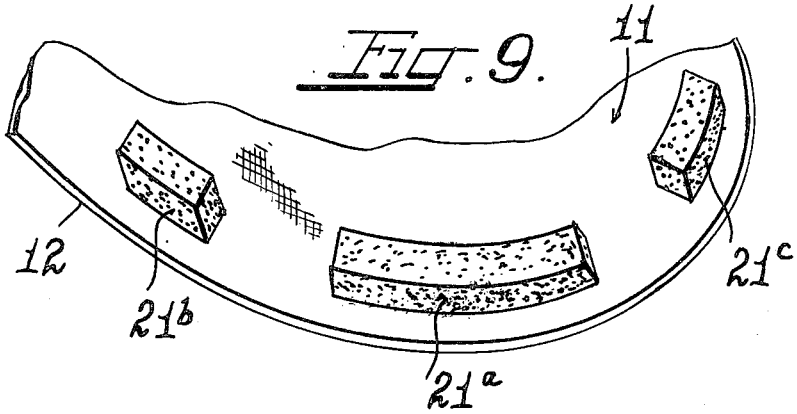
FIG. 9 is a perspective view of the inside of the crown of the cap illustrating another manner of locating absorptive member therein.

Here, the pad 21 is used in its original form, that is, in one piece, while in FIG. 9, the the pad has been dissected into several parts 21*a*, 21*b* and 21*c* for selective attachment inside the crown, so as to present absorbent material in selective areas of excessive perspiration.

Figure 7:
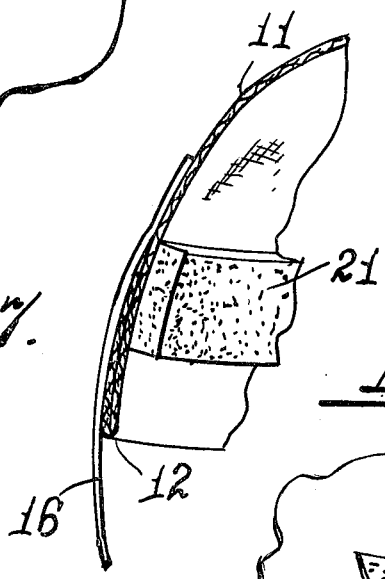
FIG. 7 is a sectional view of the front portion of the cap, showing the positioning of the tape and the absorptive member when the cap rim is folded outwardly and upwardly.

In FIG. 7, the cap 11*a* has its rim 12 folded up, to accommodate the wearer, hence the pad 21 or pads 21*a*, etc, are located some distance inwardly from the rim so as to be postured at the required place for maximum absorption of prespiration.

Of course, the support means herein disclosed can be engaged with or secured to any portion of the eyeglasses, such as the lense rim or rims 23 or the bows 24 thereof.

Although I have described various embodiments of the invention, in considerable detail, it will be understood that the description thereof is intended to be illustrative rather than restrictive, as details of the structures may be modified and/or changed without departing from the spirit or scope of the invention. Accordingly, I do not desire to be restricted to the exact construction shown and described.

I claim:

1. A cap adapted to be placed on the head of a person wearing eyeglasses, said cap having a crown and a rim, the latter being arranged above the eyeglasses, and means removably secured to the outside surface of the crown re-positionable for engagement with the eyeglasses to retain them in a selected position on the nose of the wearer with said means exerting a resistive force to movement of the eyeglasses in both up and down directions.

2. The structure recited in claim 1, wherein the means removably secured on the outside surface of the crown comprises an elongated adhesively coated piece of pliable shape-retaining material.

3. A surgical headwear for persons wearing eyeglasses having a nose bridge, said headwear including a rim and a crown, a strip of pliable material attached to the outside surface of the crown, a moisture absorption element attached to the outside surface of the headwear, said strip being removable from the headwear for repositioning in engagement with the nose bridge and the crown, and the absorption element also being removable for relocation on the inside surface of the crown closely adjacent to the rim.

4. A headgear comprising a surgical cap and mask, the latter to cover part of the nose, the mouth and the chin of a person wearing eyeglasses having a nose bridge; and a cap to fit snuggly over the head of the wearer including a crown to cover the top area of the head and a rim area overlying the wearer's forehead, spectacle support means normally attached to the outside surface of the crown, said support means comprising a strip of flexible shape-retaining material having adhesive means thereon adapting the strip to be removed from the crown when in use and be re-secured in a substantially vertical position to overlay the rim area, the nose-bridge, the nose and an area of the mask for retaining the eyeglasses against displacement on the nose.

5. The headgear recited in claim 4, wherein the cap has a perspiration absorption element carried on the outside of the cap removable for replacement inside the rim.

6. The headgear recited in claim 4, wherein the spectacle support means is attached to the crown adjacent to the rim area.

7. A cap adapted to be placed on the head of a person wearing eyeglasses, said cap having a crown and a rim, the latter being arranged above the eyeglasses, and means removably secured to the outside surface of the crown re-positionable for engagement with the eyeglasses to retain them in a selected position on the face of the wearer with said means exerting a resistive force to movement of the eyeglasses in both up and down directions.

8. A cap adapted for use by a person wearing eyeglasses, said cap having a crown portion and a rim, a moisture absorption element detachably secured on the outside surface of the crown portion, said moisture absorption element being removable from the outside surface of the crown for reattachment on the inside surface of the crown closely adjacent to the rim, removable eyeglasses securing means carried by the cap in an ineffective position, said means comprising a pliable strip having a pressure sensitive adhesive on at least one surface adapted to be relocated to engage with the cap and with the eyeglasses to retain them in a select position of use.

* * * * *